US005099912A

United States Patent [19]

Tajima et al.

[11] Patent Number: 5,099,912

[45] Date of Patent: Mar. 31, 1992

[54] HOUSINGLESS OIL COOLER

[75] Inventors: Makoto Tajima, Tokyo; Kuniaki Ohki; Kei Beppu, both of Kanagawa; Hiroyuki Yoshida, Tokyo, all of Japan

[73] Assignee: Calsonic Corporation, Tokyo, Japan

[21] Appl. No.: 734,754

[22] Filed: Jul. 23, 1991

[30] Foreign Application Priority Data

Jul. 30, 1990 [JP] Japan ..... 2-201828
Jul. 30, 1990 [JP] Japan ..... 2-201829
Nov. 14, 1990 [JP] Japan ..... 2-308210

[51] Int. Cl.[5] ..... F28F 19/02

[52] U.S. Cl. ..... 165/133; 165/134.1; 165/167; 165/916

[58] Field of Search ..... 165/133, 134.1, 167, 165/916

[56] References Cited

U.S. PATENT DOCUMENTS 4,708,199 11/1987 Yogo et al. ..... 165/167
4,742,866 5/1988 Yamanaka et al. ..... 165/38
4,892,136 1/1990 Ichihara et al. ..... 165/51
4,955,525 9/1990 Kudo et al. ..... 228/183
5,054,549 10/1991 Nakaguro ..... 165/133

FOREIGN PATENT DOCUMENTS 62-125870 8/1987 Japan .
63-74973 5/1988 Japan .

*Primary Examiner*—Allen J. Flanigan
*Attorney, Agent, or Firm*—Brumbaugh, Graves, Donohue & Raymond

[57] ABSTRACT

A core for a housingless oil cooler has alternate cooling water passageways and oil passageways, including two sets of aluminum plates coated on one side with a sacrificial corrosion layer and on the other side with a brazing filler metal layer, each plate having a peripheral rim projecting from the outer periphery. The plates of the first and second sets are assembled alternately and arranged so that the brazing filler metal layer coated on each plate of the first set is adjacent to the sacrificial corrosion layer of the next plate of the first set and the plates of the second set have a sacrificial corrosion layer opposed to the sacrificial corrosion layer of the adjacent plate of the first set to define a cooling water passageway therebetween, and the brazing filler metal layer on the outer surface of the peripheral rim of the plates of the second set is bonded to the inner surface of the peripheral rim of the adjacent plate of the first set.

11 Claims, 6 Drawing Sheets

HOUSINGLESS OIL COOLER

BACKGROUND OF THE INVENTION

This invention relates to cores for housingless oil coolers for automobiles and the like and, more particularly, to cores for housingless oil coolers which are formed by stacking plate members.

Japanese Published Unexamined Utility Model Applications Nos. 125870/1987 and 74973/1988 disclose housingless oil coolers formed by stacking plate members of the type shown in FIGS. 1-3 of the drawings herein. As shown in FIG. 1, a housingless oil cooler has a core 11 which is formed by alternately stacking first and second plates 13 and 15 of stainless steel having different shapes so that cooling water passageways 17 and oil passageways 19 are formed alternately therebetween.

The core 11 of such conventional oil coolers is quite heavy because it contains a number of stainless steel plates 13 and 15 as described above. This interferes with the desired reduction of the total weight of an automobile. Therefore, there has been a strong demand for a light-weight core for a housingless oil cooler which is made of a coated aluminum material.

However, the manufacture of a core such as the core 11 of a conventional housingless oil cooler using a coated aluminum material gives rise to the following difficulties: The coated aluminum material, as shown in FIG. 2, comprises an aluminum base layer 21, a sacrificial corrosion layer 23 on one side of the base layer 21, and a brazing filler metal layer 25 on the other side of the base layer. Such coated aluminum material is pressed to form the first plates 13 and the second plates 15, which are then stacked to provide the core as shown in greater detail in FIG. 3. In that illustration, a space X is defined by the sacrificial corrosion layer 23 of the second plate 15 and the brazing filler metal layer 25 of the first plate 13 to provide a cooling water passageway. If highly corrosive cooling water is used in the cooling water passageway X, however, the brazing filler metal layer 25 of the first plate 13 suffers from pit corrosion, causing a number of pinholes to be formed in that plate.

On the other hand, a space Y in FIG. 3 defined by the sacrificial corrosion layer 23 of the first plate 13 and the brazing filler metal layer 25 of the second plate 15 may be used as a cooling water passageway. In that case, if highly corrosive cooling water is used the brazing filler metal layer 25 of the second plate 15 suffers from pit corrosion, causing pinholes to be formed in that plate.

In the core of a conventional housingless oil cooler, the plates 13 and 15 are arranged in this way to make use of o the brazing of those plates, and therefore each cooling water passageway is bounded by the brazing filler metal layer 25 of one of the plates 13 and 15. This brazing filler metal layer 25 is subject to attack by corrosion, thus reducing the service life of the core.

FIGS. 4 and 5 show conventional core structures based on modifications of the first and second plates 13 and 15. These plates 13 and 15 are formed with the same configuration as those shown in FIG. 3, but they are coated differently so that, when they are stacked, the brazing filler metal layers 25 are in contact with each other, and accordingly the sacrificial corrosion layers 23 are in contact with each other. However, this arrangement has the disadvantage that, where only the sacrificial corrosion layers 23 are in contact with each other, the plates cannot be bonded together.

SUMMARY OF THE INVENTION

Accordingly, an object of this invention is to provide a core for a housingless oil cooler which eliminates the above-mentioned disadvantages of the prior art.

Another object of the invention is to provide a core for a housingless oil cooler in which the surfaces of plates defining cooling water passageways are positively protected from pit corrosion.

A further object of the invention is to provide a core for a housingless oil cooler which has a dimensionally precise bonded structure after brazing.

These and other objects of the invention are attained by providing a core for a housingless oil cooler with alternate cooling water passageways and oil passageways having plate members made of a coated aluminum material with a first coating of a sacrificial corrosion layer on one surface and a second coating of a brazing filler metal layer on the other surface and having a peripheral rim extending away from the plane of the plate member at the outer periphery thereof, each of a first plurality of plate members being formed so that the inner surface of its peripheral rim receives and engages the outer surface of the peripheral rim of one of a second plurality of plate members, having the surfaces of adjacent plate members which are in facing relation having the same coating to provide a passageway lined with layers of the same coating on both plate members, and at least one surface of the second coating on the engaging rim surfaces of the plate members to permit bonding of the members by the brazing filler metal coated on the engaging surface of one of the members.

The peripheral rim of each of the first plurality of plate members is also formed with a larger diameter projection to receive the outer surface of the rim of another of the first plurality of plate members in nested relation so as to form a second passageway between one of the first plurality of members and an adjacent one of the second plurality of members which has facing surfaces coated with the second coating so that the second passageway is lined with layers of the other of the first and second coatings. Each of the passageways lined with the first coating is used as a cooling water passageway and each of the passageway lined with the second coating is used as an oil passageway.

As used herein, the term "inner surface" means the surface of a plate member containing the inner surface of the projecting rim and the term "outer surface" means the opposite surface of the plate member.

In one embodiment of the invention, each of the plate members has the sacrificial corrosion layer on its inner surface and the brazing filler metal layer on its outer surface. Thus, the brazing filler metal layer forming the outer surface of the peripheral rim of each second plate member is bonded to the sacrificial corrosion layer on the inner surface of the peripheral rim of the first plate member which receives a second plate member therein. In this case, the second plate member is received within the first plate member so that the peripheral rim of the second plate member extends away from the plane of that member in a direction opposite to the direction in which the peripheral rim of the first plate member extends away from the plane of the first plate member. Accordingly, the cooling water passageway is formed by the sacrificial corrosion layers on the inner surfaces of the first and second plate members. The peripheral rim of the first plate member includes a smaller diameter portion extended from the body of the first plate member, and a larger diameter portion projecting from the smaller diameter portion in such a manner that the larger diameter portion provides an opening having an inside diameter equal to the outside diameter of the smaller diameter portion. Thus, the small diameter portion of each first plate member is engaged with and bonded to the larger diameter portion of the adjacent first plate member by brazing.

In another embodiment, each first plate member has the brazing filler metal layer on its inner surface and the sacrificial corrosion layer on its outer surface. In this case, the second plate member is mounted in the first plate member so that the peripheral rim of the second plate member extends away from the body of the second plate in the same direction in which the peripheral rim of the first plate member extends away from the body of the first plate. The brazing filler metal layer coated on the outer surface of the peripheral rim of the second plate member is welded to the brazing filler metal layer coated on the inner surface of the peripheral rim of the first plate member so that the cooling water passageway is formed by the sacrificial corrosion layers on the outer surface of the first plate member and on the inner surface of the second plate member. In this case, too, the peripheral rim of each first plate member includes a smaller diameter portion projecting from the body of the first plate member, and a larger diameter portion projecting from the smaller diameter portion so that the larger diameter portion provides an opening with an inside diameter equal to the outside diameter of the smaller diameter portion. The outer surface of the rim of the smaller diameter portion of each first plate member is engaged with and bonded to the inner surface of the peripheral rim of the larger diameter portion of the adjacent first plate member by brazing.

The first and second plate members also have central through-holes and are stacked alternately with an aluminum pipe inserted into the central through-holes. Thereafter, the pipe is expanded outwardly, so that the first and second plate members are rigidly secured to the pipe. In this condition, the plates are thereafter bonded to each other and to the central pipe.

BRIEF DESCRIPTION OF THE DRAWINGS

Further objects and advantages of the invention will become more apparent from a reading of the following detailed description in conjunction with the accompanying drawings, in which.

DESCRIPTION OF PREFERRED EMBODIMENTS

Preferred embodiments of this invention will be described with reference to the accompanying drawings.

First, a housingless oil cooler having a representative core arranged in accordance with a first embodiment of the invention will be described with reference to FIGS. 6–9.

Figure 1:
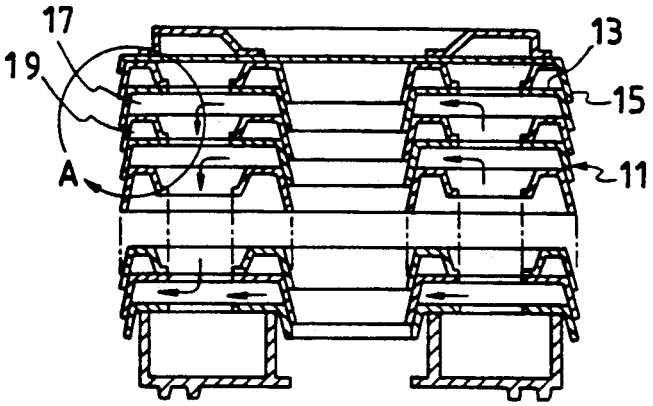
FIG. 1 is a vertical sectional view illustrating the core of a conventional housingless oil cooler.
Figure 2:
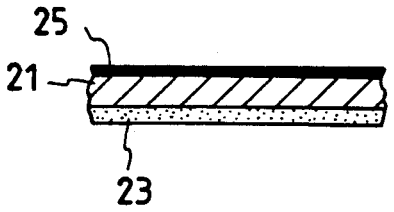
FIG. 2 is a fragmentary sectional view of an aluminum plate coated with layers of sacrificial corrosion material and brazing filler metal.
Figure 3:
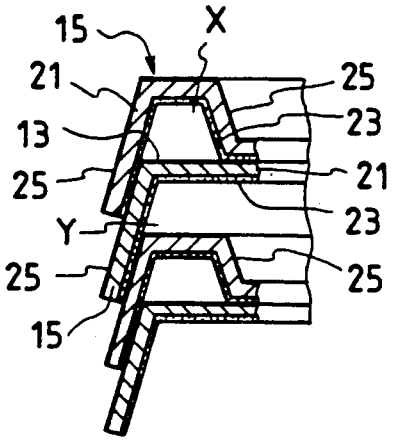
FIGS. 3, 4 and 5 are enlarged vertical sectional views illustrating the portion designated A in FIG. 1, showing examples of different conventional arrangements of a core in the housingless oil cooler shown in FIG. 1 using the coated aluminum material shown in FIG. 2.
Figure 4:
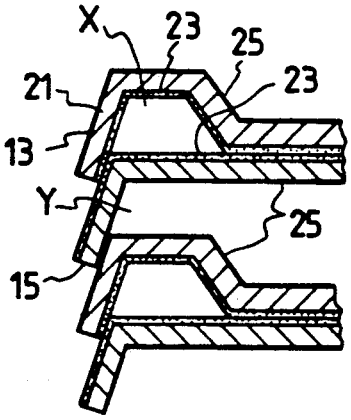
Figure 5:
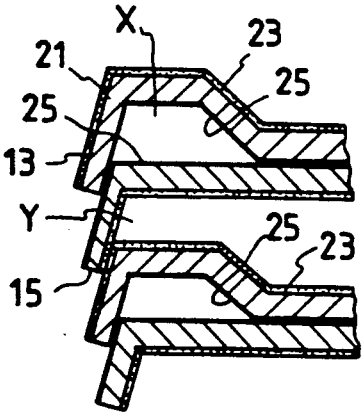
Figure 6:
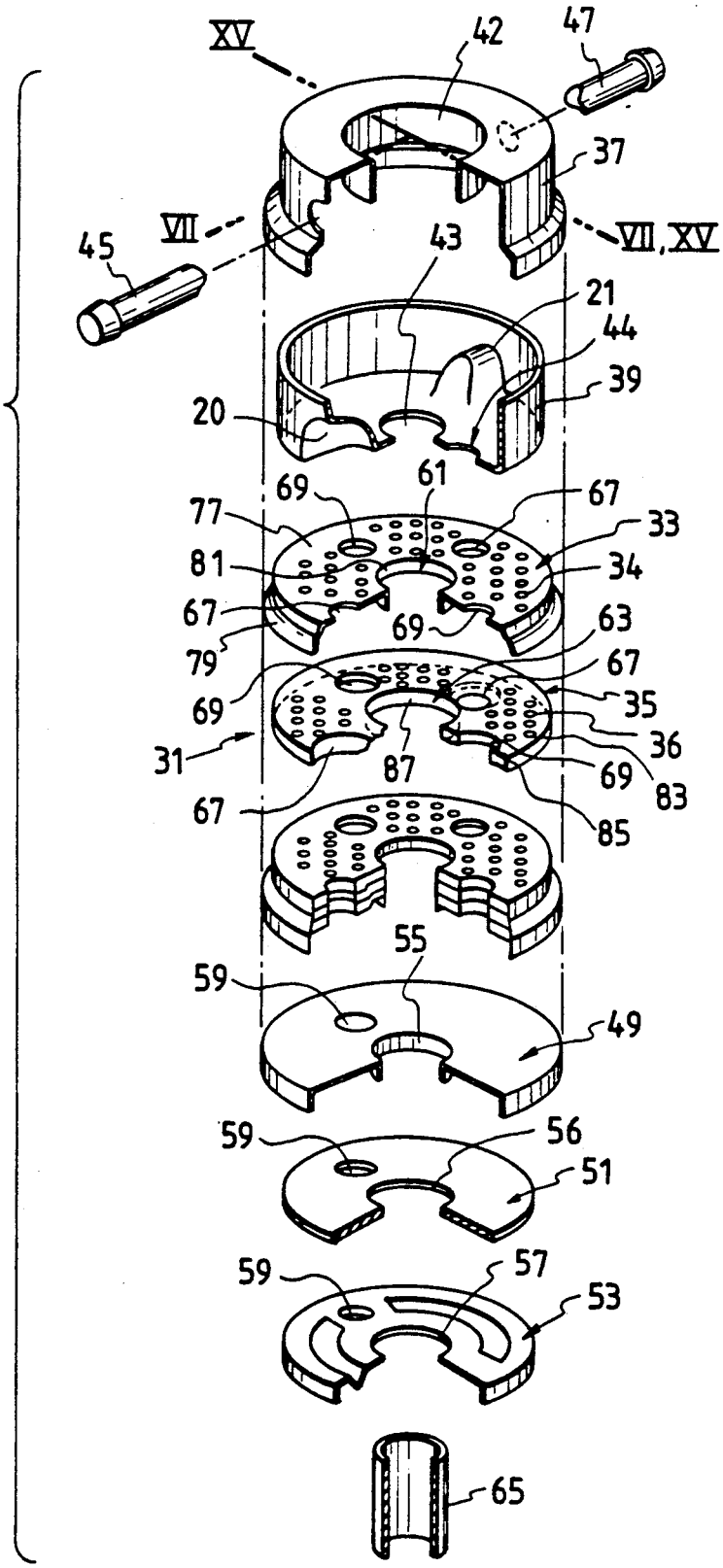
FIG. 6 is an exploded perspective view showing a typical example of a housingless oil cooler having a core arranged in accordance with one embodiment of the present invention.
Figure 7:
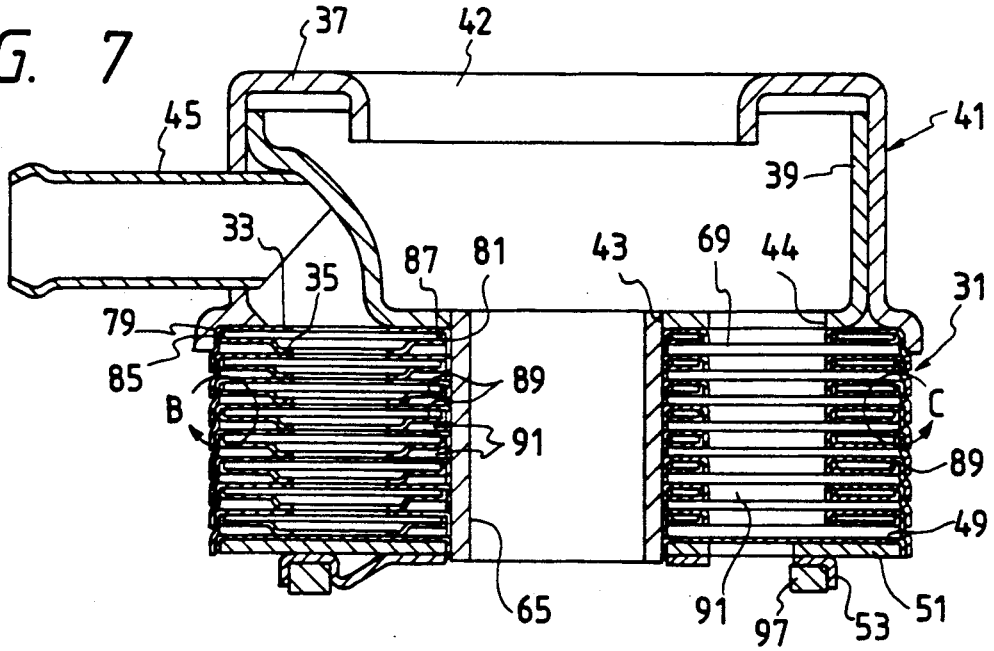
FIG. 7 is a vertical sectional view taken along the line VII—VII in FIG. 6.

As illustrated in FIGS. 6 and 7, a core 31 is formed by alternately stacking two sets of differently shaped first and second plates 33 and 35.

A tank 41 is mounted on the upper portion of the core 31. The tank 41 comprises an upper casing 37 and a lower casing 39 which are both made of aluminum. Preferably, the upper casing 37 may be coated with a brazing filer metal layer on its inside surface, whereas the lower casing 39 may be coated with a brazing filer metal layer on its outside surface. The upper casing 37 has a through-hole 42 at the center, whereas the lower casing 39 has a through-hole 43 at the center and a through-hole 44 between the through-hole 43 and an upwardly extending peripheral rim. The upper casing 37 is connected to a cooling water intake pipe 45 through which cooling water flows into the core and a cooling water discharge pipe 47 through which cooling water flows out of the core.

At the lower end of the core 31, a base plate 49, a reinforcing plate 51 and a mounting plate 53 are provided. The plates 49, 51 and 53 are arranged in the specified order and made of aluminum. Preferably, the base plate 49 may be coated with a brazing filler metal layer on its outside surface, whereas the reinforcing plate 51 may be coated with a brazing filler metal layer on its upper surface. Also, it is preferable to coat the mounting plate 53 with a brazing filler metal layer on its outside surface. The plate 49 has a through-hole 55 at the center, and an oil intake hole 59 between the central through-hole 55 and a downwardly extending peripheral rim. Similarly, the plate 51 has a through hole 56 at the center, and an oil intake hole 59 between the central through-hole 56 and a periphery thereof, while the plate 53 has a through-hole 57 at the center, and an oil intake hole 59 between the central through-hole 57 and a downwardly extending peripheral rim. A packing 97 is mounted on the lower surface of the mounting plate 53 as shown in FIG. 7.

The first plates 33 and the second plates 35 forming the core 31 have central through-holes 61 and 63, respectively. An reinforcing pipe 65, through which a pipe forming an oil discharge passageway is to be inserted (described in detail below), is inserted into the through-holes 61 and 63 as shown in FIG. 7. The reinforcing pipe 65 may preferably be coated with a brazing filler metal layer on its outside surface. The insertion of the reinforcing pipe 65 into the central through-holes 61 and 63 contributes to an improvement in product accuracy of the core after brazing as described hereinafter.

In each of the first and second plates 33 and 35, four through-holes are formed around the central through-holes at predetermined angular intervals (for instance 90°). Two of the four through-holes which are diametrically opposite to each other are employed as cooling water passageway holes 67, and the other two are employed as oil passageway holes 69.

As described above, the first and second plates 33 and 35 are stacked alternately. As shown in FIG. 6, a number of protrusions 34 are formed on the surfaces 77 of each of the first plates 33 in order to improve the heat exchange effectiveness. Similarly, a number of protrusions 36 are formed on the surfaces 83 of each of the second plates 33 in order to improve the heat exchange effectiveness.

Figure 10:
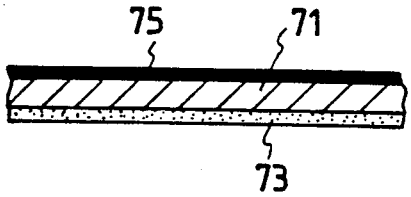
FIG. 10 is an enlarged fragmentary sectional view showing a coated aluminum material which is used to form first and second plates in a core arranged according to the invention.
Figure 11:
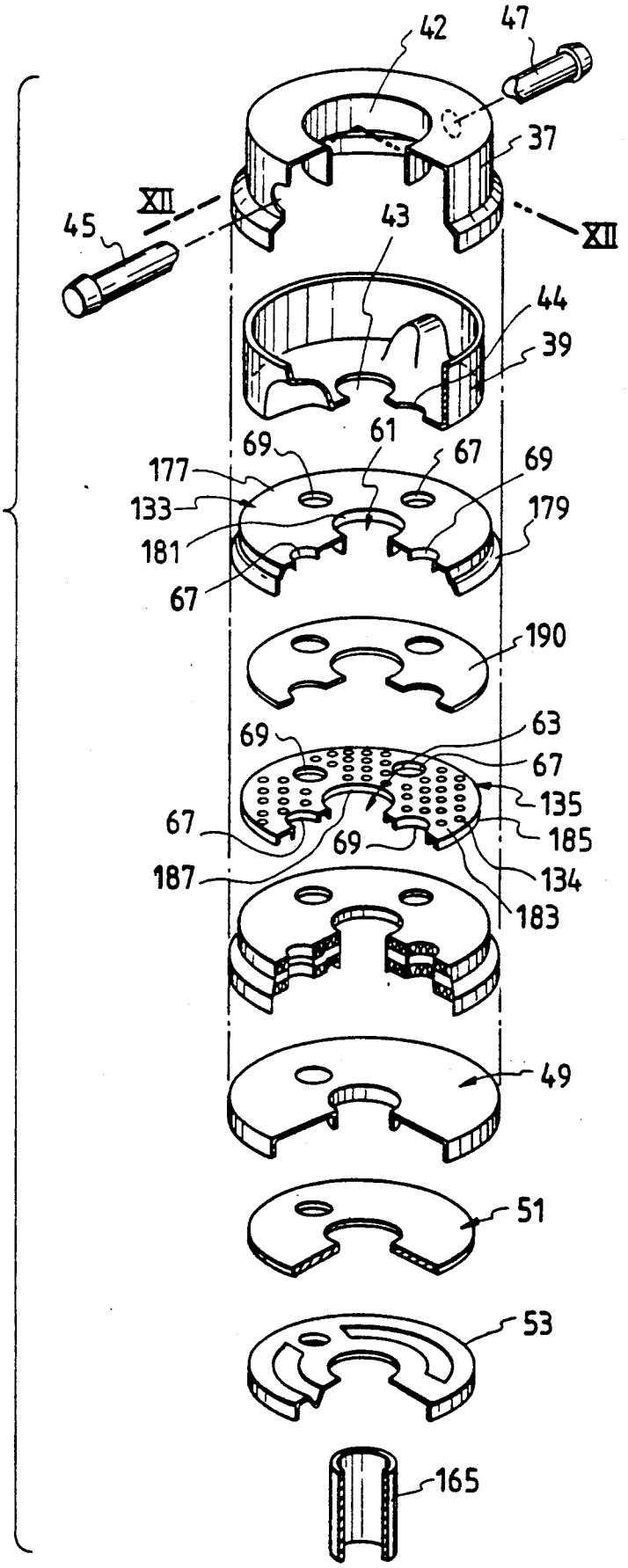
FIG. 11 is an exploded perspective view showing another typical embodiment of housingless oil cooler having another example of a core in accordance with a second embodiment of the invention.
Figure 14:
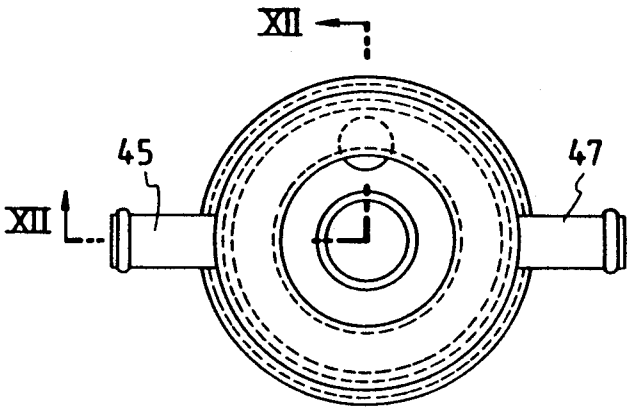
FIG. 14 is a top view of the housingless oil cooler shown in FIG. 11.
Figure 12:
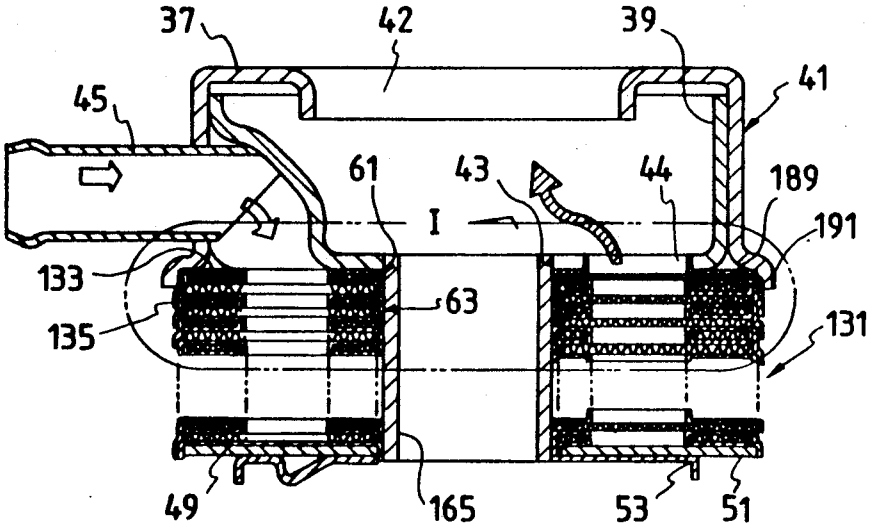
FIG. 12 is a vertical sectional view taken along line XII—XII in FIG. 11.
Figure 13:
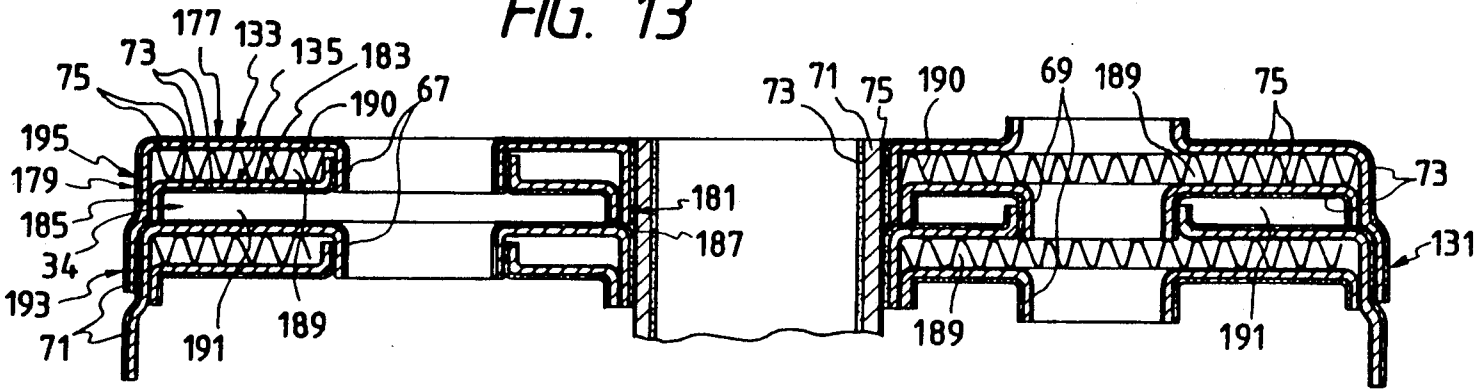
FIG. 13 is a vertical sectional view showing the portion designated I in FIG. 12 in greater detail.

In the embodiment shown in the drawings, the first and second plates 33 and 35 are formed by pressing a coated aluminum material. The coated aluminum material, as shown in FIG. 10, is formed by coating a sacrificial corrosion layer 73 on one surface of an aluminum sheet material 71 and a brazing filler metal layer 75 on the other surface.

The aluminum sheet material may, for example, be a conventional aluminum alloy having 0.05–0.20 Cu, 1.0–1.5 Mn, up to 0.6 Si, up to 0.7 Fe and up to 0.1 Zn. The sacrificial corrosion layer 71 may, for example, be an aluminum alloy having a higher content of elements which are lower than aluminum in the electrochemical series. One such alloy has 0.5–1.1 Mg and up to 0.1 Cr, 0.25 Zn, 0.2 Cu, 0.2 Mn, 0.3 Si and 0.7 Fe and the balance Al. Another suitable alloy for the sacrificial corrosion layer has 0.8–1.3 Zn, up to 0.1 each of Cu, Mn and Mg and up to 0.7 Si and Fe combined and the balance Al. Such sacrificial corrosion coatings, when exposed to highly corrosive water, tend to exhibit surface corrosion over an extended period of time, but no pit corrosion so that the underlying aluminum layer is protected. The brazing filler metal layer 75 may, for example, be an alloy containing 6.8–8.2 Si, up to 0.8 Fe, up to 0.25 Cu, up to 0.1 Mn, up to 0.2 Zn, up to 0.15 impurities (up to 0.05 each) and the balance Al or an alloy containing 9.0–11.0 Si, up to 0.8 Fe, up to 0.3 Cu, up to 0.05 Mn, up to 0.05 Mg, up to 0.1 Zn, up to 0.2 Ti, up to 0.15 impurities (up to 0.05 each) and the balance Al. All of the foregoing concentrations are specified in weight percent.

As described above, in the embodiment shown in the drawings, the upper casing 37, the lower casing 39, the base plate 49, the reinforcing plate 51 and the mounting plate 53 may be formed by pressing a coated aluminum material coated with a brazing filler metal layer on one surface thereof. For the casings 37 and 39 and the plates 49, 51 and 53, it is not necessary to use a coated aluminum material coated with a sacrificial corrosion layer on the other surface since it requires much more time to form pinholes in the relatively thick upper and lower casings 37 and 39, and to pinholes passing through both the plates 49 and 51 welded together.

Cylindrical rim projections 79 and 81 extend downwardly as shown in FIG. 6 from the outer periphery of each first plate body 77 and from the edge of the central through-hole thereof, respectively. In the example shown in FIGS. 6–9, the sacrificial corrosion layer 73 is on the inner surface of these projections and on the lower surface of the plate body.

On the other hand, cylindrical projecting rims 85 and 87 extend upwardly as viewed in the drawings from the outer periphery of each second plate body 83 and from the edge of the central through-hole thereof toward the first plate body 77, respectively, with the sacrificial corrosion layer 73 on the inside surface of the projections and on the upper surface of the second plate body.

Figure 8:
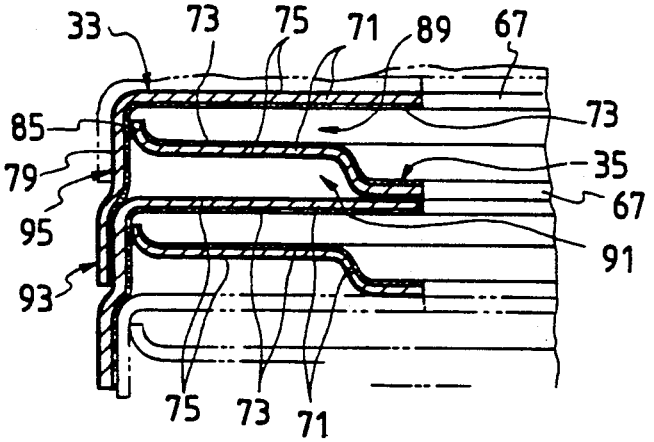
FIGS. 8 and 9 are enlarged vertical sectional views showing the portions designated B and C in FIG. 7, respectively, in greater detail.

As shown in FIGS. 7 and 8, the brazing filler metal layers 75 forming the outer surfaces of the upwardly projecting rims 85 and 87 of the second plate 35 are bonded to the sacrificial corrosion layer 73 providing the inner surfaces of the downwardly projecting rims 79 and 81 of the first plate 33. As a result, the sacrificial corrosion layer 73 on the inner surface of the first plate 33 and the sacrificial corrosion layer 73 on the inner surface of the second plate 35 form a cooling water passageway 89 completely surrounded by sacrificial corrosion material. The brazing filler metal layer 75 forming the outer surface of the second plate 35, the brazing filler metal layer 75 forming the outer surface and the upper surface of the adjacent first plate 33 on one side of the plate 35, and the sacrificial corrosion layer 73 forming the inner surface of the downwardly projecting rims 79 and 81 of the first plate 33 on the other side of the plate 35 define an oil passageway 91.

In this embodiment, the cylindrical portion 79 of the first plate 33 is made up of a smaller diameter portion 95 projecting from the plate body 77 and a larger diameter portion 93 extending from the smaller diameter portion. The adjacent first plates 33 are bonded together in such a manner that the inner surface of the larger diameter portion 93 of one first plate 33 is brazed to the outer surface of the smaller diameter portion 95 of the next lower first plate 33, as seen in the drawings. This arrangement of the plates provides a continuous connection of all of the cooling water passages in the unit.

Figure 9:
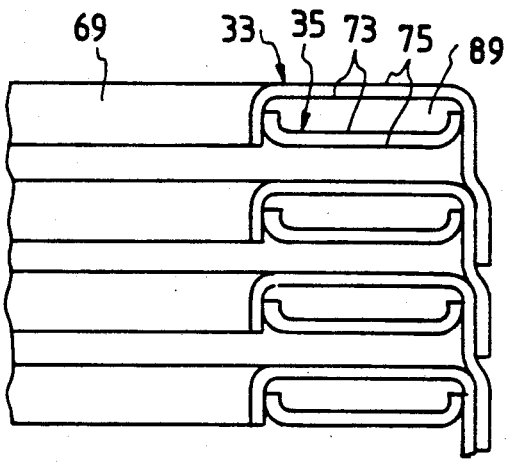

As shown in FIG. 9, the first plates 33 have downwardly projecting rims adjacent to the oil passage openings 69, whereas the second plates 35 have upwardly projecting rims received inside the downwardly projecting first plate rims adjacent to those openings. As a result, continuous communication is provided through the openings 69 with all of the oil passages 91.

In this housingless oil cooler, the sets of first and second plates 33 and 35 are assembled in such a manner that the projecting cylindrical rims 79 and 81 of a first plate 33 are engaged with the projecting rims 85 and 87 of the second plate 33 adjacent to the first plate 33, and the larger diameter rim portion 93 of the first plate 33 engages the smaller diameter rim portion 95 of the adjacent first plate 33. Thereafter, the reinforcing pipe 65 is inserted into the central through-holes 61 and 63 of the sets of first and second plates 33 and 35 to form the core 31. Thereafter, the upper and lower casings 37 and 39, the base plate 49, the reinforcing plate 51, and the mounting plate 53 are coupled to the other members of the core 31. The resultant assembly is coated with non-corrosive flux and dried. Thereafter, the assembly is heated in a furnace, and all of the surfaces in contact with a coating of brazing filler material are bonded together by brazing.

In the core for a housingless oil cooler thus formed, the first and second plates 33 and 35 are made from a coated aluminum material which has a sacrificial corrosion layer 73 on one side of an aluminum layer 71 and a brazing filler metal layer 75 on the other side, and the first and second plates 33 and 35 thus formed are stacked alternately. In addition, the projecting rim 79 extends from the outer periphery of the plate body 77 of the first plate 33 with the sacrificial corrosion layer 73 on the inside, while the projecting rim 85 extends from the outer periphery of the plate body 73 of the second plate 35 towards the plate body 77 of the first plate with the sacrificial corrosion layer 73 on the inside, so that the brazing filler metal layer 75 on the outer surface of the projecting rim 85 is brazed to the sacrificial corrosion layer 73 on the inner surface of the projecting rim 79. That is, the sacrificial corrosion layers 73 of the first and second plates 33 and 35 which are adjacent to each other form the cooling water passageway 89. Hence, the surfaces of the first and second plates 33 and 35 which define the cooling water passageway 89 are positively protected from pit corrosion.

Furthermore, in this arrangement of a core for a housingless oil cooler, the projecting rim 79 of each first plate 33 is made up of the smaller diameter portion 95 projecting from the first plate body 77 and the larger diameter portion 93 projecting from the smaller diameter portion. The first plates 33 are bonded together after the larger diameter portion 93 of a first plate 33 is fitted to the smaller diameter portion 95 of the adjacent first plate 33. This arrangement of the first plate 33 allows the first and second plates 33 and 35 to be accurately assembled before being brazed, and contributes to an improvement in product accuracy of the core produced by brazing them.

In order to further improve the dimensional accuracy of the core, it is preferable to employ the following method: all of the first and second plates are assembled in such a manner that the projecting rims 79 and 81 of each first plate 33 receive and are engaged with the projecting rims 85 and 87 of the second plate 35 adjacent to the first plate 33, and the larger diameter portion of the rim of each first plate 33 is engaged with the smaller diameter portion of the rim of the next first plate 33. Thereafter, the reinforcing pipe 65 is inserted, as a communication pipe, into the central through-holes 61 and 63 of the sets of first and second plates 33 and 35.

In this condition, the reinforcing pipe 65 is expanded outwardly, for instance, by a liquid pressure expansion method, so that all of the first and second plates 33 and 35 are rigidly affixed to the reinforcing pipe 65. Because the reinforcing pipe 65 is made of aluminum, it can be enlarged with a relatively low pressure.

Thereafter, as described above, the upper and lower casings 37 and 39, the base plate 49, the reinforcing plate 51, and the mounting plate 53 are joined to the core 31 thus formed. The resultant assembly is coated with noncorrosive flux, and dried. Thereafter, the assembly is heated in a furnace so that the contacting surfaces are connected by brazing.

Instead of coating the entire assembly with noncorrosive flux, a layer of noncorrosive flux may be applied to the first and second plates, or at least to the brazing filler metal layers on those plates, before they are assembled. The flux may be applied in the form of a powder or it may be applied as liquid flux and then dried before the plates are assembled. Although this procedure results in a layer of flux being interposed between two surfaces which are to be welded, it does not detract from the welding of the surfaces.

In the above-described core for a housingless oil cooler, the first and second plates 33 and 35 and the reinforcing pipe 65 are made of aluminum, and the reinforcing pipe 65 is expanded outwardly after being inserted into the central through-holes 61 and 63 of the assembled sets of first and second plates 33 and 35, so that all of the first and second plates 33 and 35 are rigidly secured to the reinforcing pipe 65, and then the assembled sets of first and second plates 33 and 35 are brazed together. This procedure prevents any change in the relative positions of the plates when the core assembly is conveyed between manufacturing stations, or heated in the furnace. Thus, the core structure has highly accurate dimensions after it has been brazed.

In the procedure described above, the reinforcing pipe 65, or the communication pipe, is expanded with liquid pressure, but the invention is not limited to that procedure. It goes without saying that such expansion can be accomplished in other ways, for example, with a pipe expansion jig.

Furthermore, in the above-described embodiment, only the sets of first and second plates 33 and 35 are positively attached to the reinforcing pipe 65 by expanding the pipe. However, the following procedure may be used instead. After the upper and lower casings 37 and 39, the base plate 49, the reinforcing plate 51 and the mounting plate 53 are joined to the core 31, the reinforcing pipe 65 is expanded so that all the components are rigidly attached to it. Thereafter, the components are brazed in the furnace as described above. The use of this procedure prevents any change in the position of any of the components when the assembled components are conveyed or are heated in the furnace. As a result, the entire assembly has a high dimensional accuracy after it has been brazed.

For manufacturing the core of the present invention, it is also applicable to employ the following method: A first plate 33 and a second plate 35 are coupled to each other so that inner surfaces of the downwardly projecting rims projecting from the oil passage openings 69 of the first plate 33 are engaged with outer surfaces of the upwardly projecting rims projecting from the oil passage openings 69 of the second plate 33. Then, the downwardly projecting rims of the first plate 33 are rigidly affixed to the upwardly projecting rims of the second plate 35 by expanding the downwardly projecting rims outwardly, thereby providing a shell assembly unit comprised of the first and second plates. The noncorrosive flux may be applied to the first and the second plates before they are assembled, or otherwise, may be applied to the shell assembly unit. The core 31 is assembled by stacking desired number of the shell assembly units. The tank 41 and the plates 49, 51 and 53 are mounted onto the core 31 thus assembled. The flux may be applied to the plates 49, 51 and 53 before mounting them onto the core 31. After that, the core 31, the tank 41 and the plates 49, 51 and 53 are rigidly affixed to the reinforcing pipe 65 onto which the flux is applied in advance by inserting the reinforcing pipe 65 into the holes 43, 61, 63, 55, 56 and 57 and then expanding the pipe 65 outwardly. The flux is applied to the resultant product and dried. The resultant product with the flux thereon is then heated in a furnace so that the contacting surfaces are connected by brazing.

In the housingless oil cooler having the core provided in accordance with the invention, the tank 41 is bonded to the upper most first plate 33 such that one of the oil passageway holes 69 on the upper most first plate 33 is closed by an outside surface of a bottom of the lower casing 39, and the other is positioned to correspond to the through-hole 44 of the lower casing 39. Accordingly, the oil to be cooled flows inside the lower casing 39 through the oil passageway hole 69 and the through-hole 44.

On the other hand, one of the cooling water passageway holes 67 on the upper most first plate 33 is positioned to below a recess 20 of the lower casing 39, to thereby define a cooling water intake port outside the lower casing 39. The other of the cooling water passageway holes on the upper most first plate 33 is positioned to below another recess 21 of the lower casing to thereby define a cooling water discharge port outside of the lower casing 39.

The upper surface of the upper most first plate 33 is coated with the brazing filler metal layer, so that pinholes may be formed in portions of the upper most first plate 33, where the recesses 20 and 21 are positioned. However, even if the pinholes is formed in the portions, there occurs no problem since a cooling water passageway is disposed below the portions.

The base plate 49 is bonded to the lower most second plate 35 such that both of the cooling water passageway holes 67 on the lower most second plate 35 are closed by an upper surface of the base plate 49. One of the oil passage way holes 69 on the lower most second plate 35 is positioned above the oil intake hole 59 of the base plate 49, whereas the other is closed by the upper surface of the base plate 49.

Figure 15:
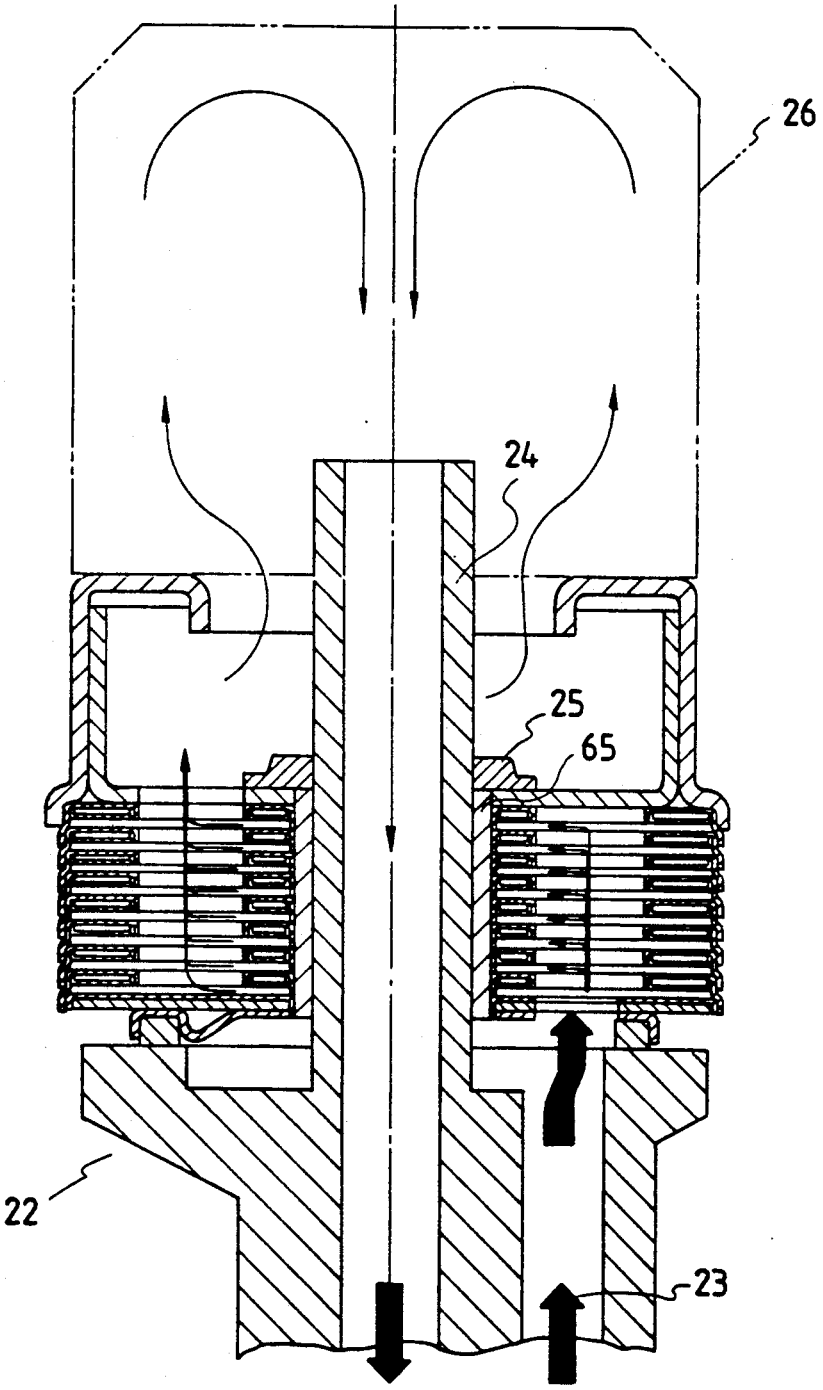
FIG. 15 is a cross sectional view of the housingless oil cooler shown in FIG. 6 taken along line XV—XV in FIG. 6, in a state that the housingless is mounted on a bracket.

The housingless oil cooler thus constructed, is mounted onto an engine, a torque convertor, or the like through a bracket 22 as shown in FIG. 15. The bracket 22 is formed with an oil intake passage way 23 through which the oil to be cooled flows from the engine, the torque convertor or the like to the oil intake holes 59. The bracket 22 includes a pipe 24 projecting from a body of the bracket 22. The pipe 24 defining the oil discharge passageway passes through the reinforcing pipe 65. The housingless oil cooler is fixed to the bracket by the threaded engagement between the pipe 24 and a nut 25.

In this arrangement of the housingless oil cooler, cooling water flows into cooling water intake port of the tank 41 through the cooling water intake pipe 45, and then flows downwardly as seen in the drawings through one set of aligned cooling water passageway holes 67 of the first and second plates 33 and 35 to fill the cooling water passageways 89 to perform heat exchange with the oil in the oil passageways 91. Thereafter, the cooling water flows upwardly through the other set of aligned cooling water passageway holes 67 in the plates, into the cooling water discharge port of the tank 41 and out through the cooling water discharge pipe 47 of the tank 41 which is isolated from the intake pipe as indicated in FIG. 7.

On the other hand, the oil to be cooled flows into the core 31 through the oil intake holes 59 formed in the lower end portion of the core 31, and then flows upwardly through the oil passageway holes 69 to fill the oil passageways 91 to perform heat exchange with the cooling water in the cooling water passageways 89. Thereafter, the oil flows into the tank 41, where it is purified by an oil filter 26. The oil thus purified is discharged through the oil discharge pipe 24.

In the above-described embodiment, the first and second plates 33 and 35 are formed with protrusions 34 and 36 in order to increase the heat-exchange effectiveness, but the invention is not limited to that arrangement. For instance, the heat exchange effectiveness can be increased by providing inner fins in the oil passageway 91. In this case, the inner fins may be made of aluminum and can be readily brazed because the oil passageway 91 is defined by the brazing filler metal layers.

However, the provision of such inner fins in the oil passageway 91 suffers from the following difficulty. If the passageway 91 is formed on the outside of the second plate 35 when a first plate 33 is assembled with the second plate 35, the inner fins are positioned on the second plate 35 at the outside of the assembly. With this arrangement, it is rather difficult to stack such assemblies of first and second plates 33 and 35 on each other because the fins are on the outside surface of each plate assembly.

This difficulty may be eliminated by modifying the core arrangement so that the cooling water is allowed to flow in the oil passageway 91, while oil is allowed to flow in the cooling water passageway 89, and the inner fins are provided in the cooling water passageway 89. As a result, the inner fins are located between the first and second plates 33 and 35 so that the fins are inside the assembly of each pair of first and second plates. In this arrangement, however, the brazing filler metal layer 75 forming the outer surface of the first plate 33 and the brazing filler metal layer 75 forming the outer surface of the second plate 35 define the cooling water passageway so that the cooling water passageway suffers from pit corrosion.

To overcome this problem, another embodiment of a core for a housingless oil cooler, which constitutes a second embodiment of the invention, will be described with reference to FIGS. 11–14. This core is so designed that the inner fins can be provided in the oil passageway without obstructing assembling of the core, and the surfaces of the plates defining the cooling water passageway are positively protected from pit corrosion.

To simplify the description, parts in FIGS. 11–14 corresponding functionally to those which have been already described with reference to FIGS. 6–10 are designated by the same reference numerals or characters.

In the second embodiment, a core 131 is formed by stacking sets of first and second plates 133 and 135 alternately. A number of protrusions 134 are formed on the plate body 183 of each second plate 135 in order to increase the heat-exchange effectiveness.

Cylindrical rims 178 and 181 project downwardly from the outer periphery of each first plate 133 and from the edge of the central through-hole of the plate body 177 thereof, respectively, with the sacrificial corrosion layer 73 on the outside surfaces of the projecting rims and the upper surfaces of the plate body as viewed in the drawing.

On the other hand, annular projecting rims 185 and 187 extend downwardly from the outer periphery of each second plate 135 and from the edge of the central through-hole of the plate body 183 thereof in the direction away from the plate body 177 of the mating first plate 133, respectively, with the sacrificial corrosion layer 73 on the inside surface of the rims and the lower surface of the plate body.

The brazing filler metal layers 75 coated on the outer surfaces of the projecting rims 185 and 187 of the second plate 135 are brazed to the brazing filler metal layers 75 forming the inner surfaces of the cylindrical portions 179 and 181 of the first plate 133, so that an oil passageway 189 is defined by the brazing filler metal layer 75 forming the inner surface of the first plate 133 and the brazing filler metal layer 75 of the second plate 125. In addition, a cooling water passageway 191 is formed by the sacrificial corrosion layer 73 forming the inner surface of the second plate 135 and the sacrificial corrosion layer 73 forming the outer surface of the first plate 133.

With this arrangement, a plurality of inner fins 190 can be fixedly mounted in the oil passageways 189 by brazing.

In this embodiment, as in the first embodiment, the projecting rim 179 of each first plate 133 is made up of a smaller diameter portion 195 projecting downwardly from the body 177 of the plate, and a larger diameter portion 195 extending from the smaller diameter portion. The first plates 133 are connected to one another by brazing in such a manner that the larger diameter portion 193 of a first plate 133 is engaged with the smaller diameter portion 195 of the adjacent first plate 133.

In this embodiment of a housingless oil cooler, the cooling water flows into the tank 41 through the cooling water intake pipe 45, and then flows downwardly through one set of aligned cooling water passageway holes 67 of the first and second plates 133 and 135 to fill the cooling water passageways 191 to perform heat exchange with the oil in the oil passageways 189. Thereafter, the cooling water flows upwardly through the other passageway holes 67 and out through the cooling water discharge pipe 47 of the tank 41.

On the other hand, the oil flows into the core 31 through the oil intake holes formed in the lower end portion of the core 31, and then flows through the oil passageway holes 69 to fill the oil passageways 189 to perform heat exchange with the cooling water in the cooling water passageways 191. Thereafter, the oil flows into the tank 41, where it is purified with an oil filter (not shown in FIGS. 11-14). The oil thus purified is discharged through the pipe 165. The pipe 165 may be used as the oil discharge pipe, or otherwise may be used as a reinforcing pipe into which another oil discharge pipe is inserted similarly to the first embodiment.

In this embodiment, after the inner fins 190 are accommodated in the cylindrical portions 179 and 181 of each first plate 133, the first and second plates 133 and 135 are assembled so that the downwardly projecting rims 179 and 181 of the first plates 133 receive and are engaged with the downwardly projecting rims 185 and 187 of the adjacent second plates 135, and the larger diameter portions 193 of the first plates 133 receive and are engaged with the smaller diameter portions 195 of the adjacent first plates 133. Then the pipe 165 is inserted into the central through-holes 61 and 63 of the sets of first and second plates 133 and 135 to form the core 31. Thereafter, the upper and lower casings 37 and 39, the base plate 49, the reinforcing plate 51, and the mounting plate 53 are joined to the core 31 thus formed. If the brazing filler metal layers of the plates 133 and 135 have not previously been coated with noncorrosive flux as described above, the entire assembly is coated with noncorrosive flux and dried. The assembly is then heated in a furnace so that the parts in contact with a brazing filler metal layer are connected by brazing.

In this core for a housingless oil cooler, the first and second plates 133 and 135 are formed by using coated aluminum material which is manufactured by providing a sacrificial corrosion layer 73 on one side of the aluminum material 71 and a brazing filler metal layer 75 on the other side, and the first and second plates 133 and 135 thus formed are stacked alternately. In addition, the projecting rim 179 extends from the outer periphery of the plate body 177 of the first plate 133 with the brazing filler metal layer 75 on the inside, while the projecting rim 185 extends from the outer periphery of the plate body 183 of the second plate 135 in the same direction, away from the plate body 177 of the first plate 133, with the sacrificial corrosion layer 73 on the inside. In addition, the brazing filler metal layer 75 coated on the outer surface of the projecting rim 185 is brazed to the brazing filler metal layer 75 coated on the inner surface of the cylindrical portion 195. Thus, the inner surface of the first plate 133 and the outer surface of the second plate 135 form the oil passageway 189 in which the inner fins 190 are mounted. As a result, the inner fins 190 can be provided in the oil passageways 189 without obstructing assembly of the core, and the surfaces of the first and second plates 133 and 135 defining the cooling water passageways 191 can be positively protected from pit corrosion.

In other words, the core for a housingless oil cooler thus constructed has a brazing filler metal layer 75 forming the inner surface of each first plate 133 and a brazing filler metal layer 75 forming the outer surface of the second plate 135 adjacent to the first plate define the oil passageway 189, and the inner fins 190 are provided in the oil passageway 189 thus defined. Hence, the inner fins 190 can be provided in the oil passageway 189 without obstructing the core assembly. Furthermore, in the core for a housingless oil cooler, the sacrificial corrosion layer 73 forming the outer surface of each first plate 133 and the sacrificial corrosion layer 73 forming the inner surface of the second plate 133 combined with a first plate form each cooling water passageway 191. Therefore, the surfaces of the first and second plates 133 and 135 which form the cooling water passageway 191 can be positively protected from corrosion.

In addition, in this embodiment of a core for a housingless oil cooler, the oil passageway 189 is formed by the brazing filler metal layer 75 forming the inner surface of each first plate 133 and the brazing filler metal layer 75 forming the outer surface of the second plate 134 combined with the first plate 133, and the inner fins 190 are provided in the oil passageway 189 thus formed. Therefore, the inner fins 190 can be positively bonded to the first and second plates 133 and 135 by brazing.

Although the invention has been described herein with reference to specific embodiments, many modifications and o variations therein will readily occur to those skilled in the art. Accordingly, all such variations and modifications are included within the intended scope of the invention.

We claim:

1. A core for a housingless oil cooler having alternate cooling water passageways and oil passageways comprising first and second pluralities of plate members, each comprising an aluminum base coated on one side with a first coating of a sacrificial corrosion layer and on the other side with a second coating of a brazing filler metal layer and having a peripheral rim projecting away from the plane of the plate member at the outer periphery thereof, each of the first plurality of plate members being formed so that the inner surface of its peripheral rim receives and engages with the outer surface of the peripheral rim of one of the second plurality of plate members, the surfaces of the first and second members which are in facing relation to each other having the same one of the first and second coatings to provide a passageway surrounded by layers of the same coating, at least one of the engaging surfaces of the peripheral rims of the first and second plate members having a brazing filer metal layer thereon to permit bonding of the engaging surfaces of the projecting rims of the first and second plate members, thereby providing cooling water passageways between opposed surfaces of first and second plate members having a coating of a sacrificial corrosion layer and oil passageways between the opposite surfaces of first and second plate members.

2. A core according to claim 1 wherein the projecting peripheral rims of each of the first and second plate members has a sacrificial corrosion layer on its inner surface and a brazing filler metal layer on its outer surface, the second plate members being combined with the first plate members so that the brazing filler metal layer on the outer surface of the peripheral rim of said one of the second plate members is bonded to the sacrificial corrosion layer on the inner surface of the peripheral rim of the first o plate members, whereby the cooling water passageways are formed by the inner surfaces of the first and second plate members.

3. A core according to claim 2 wherein the peripheral rim of each of the plurality of first plate members includes a smaller diameter portion projecting away from the body of the first plate member and a larger diameter portion extending from the smaller diameter portion, the larger diameter rim portion having an inside diameter substantially equal to an outside diameter of the smaller diameter portion so that the smaller diameter portion of one of the first plate members is engaged with and bonded to the larger diameter portion of another one of the first plate members.

4. A core according to claim 1 wherein the peripheral rim extends in a first direction from the outer periphery of each of the first plate members and the peripheral rim extends in a second direction opposite to the first direction from the outer periphery of each of the second plate members, and the second plate members are combined with the first plate members so that the peripheral rims of the second plate members are bonded to the peripheral rims of corresponding first plate members.

5. A core according to claim 4 wherein the peripheral rim of each of the plurality of first plate members includes a smaller diameter portion projecting away from the body of each of the first plate members and a larger diameter portion extending from the smaller diameter portion, the larger diameter rim portion having an inside diameter substantially equal to an outside diameter of the smaller diameter portion so that the smaller diameter portion of one of the first plate members is engaged with and bonded to the larger diameter portion of another one of the first plate members.

6. A core according to claim 1 wherein each of the first plate members has the brazing filler metal layer on its inner surface and the sacrificial corrosion layer on its outer surface, the second plate members being assembled with the first plate members so that the brazing filler metal layer on the outer surface of the peripheral rim of one of the second plate members is bonded to the brazing filler metal layer on the inner surface of the peripheral rim of one of the first plate members, whereby the cooling water passageways are defined between the sacrificial corrosion layers on the second plate members and the sacrificial corrosion layers on adjacent first plate members.

7. A core according to claim 6 wherein the peripheral rim of each first plate member includes a smaller diameter portion projecting from the body of the first plate member and a larger diameter portion extending from the smaller diameter portion, the larger diameter portion having an inside diameter substantially equal to an outside diameter of the smaller diameter portion so that the smaller diameter portion of one of the first plate members is engaged with and bonded to a larger diameter portion of another of the first plate members.

8. A core according to claim 1 wherein the peripheral rim projects from the outer periphery of each of the first plate members in a first direction, the peripheral rim projects from the outer periphery of each of the second plate members in the same direction, and the second plate members are combined with the first plate members so that the outer surface of the peripheral rim of one of the second plate members is bonded to the inner surface of the peripheral rim of one of the first plate members.

9. A core according to claim 8 wherein the peripheral rim of each first plate member includes a smaller diameter portion projecting from the body of the first plate member and a larger diameter portion extending from the smaller diameter portion, the larger diameter portion having an inside diameter substantially equal to an outside diameter of the smaller diameter portion so that the smaller diameter portion of one of the first plate members is engaged with and bonded to a larger diameter portion of another of the first plate members.

10. A core according to claim 1 wherein the first and second plate members are formed with through-holes at central portions thereof, respectively, and including a communication pipe member, and wherein the first and second plate members are stacked alternately with the communication pipe member inserted into the through-holes and rigidly affixed thereto by expanding the communication pipe outwardly.

11. A core according to claim 1, further comprising a plurality of inner fins interposed between the brazing filler metal layer on one of the first plate members and the brazing filler metal layer on one of the second plate members for improving heat exchange effectiveness.

* * * * *